US010194715B2

(12) United States Patent
Park

(10) Patent No.: US 10,194,715 B2
(45) Date of Patent: Feb. 5, 2019

(54) SHOELACE BINDING DEVICE

(71) Applicant: KYOUNGDO CO.,LTD., Gimhae-si, Gyeongsangnam-do (KR)

(72) Inventor: Chun-Bae Park, Gimhae-si (KR)

(73) Assignee: KYOUNGDO Co., Ltd (KR)

( * ) Notice: Subject to any disclaimer, the term of this patent is extended or adjusted under 35 U.S.C. 154(b) by 192 days.

(21) Appl. No.: 15/258,166

(22) Filed: Sep. 7, 2016

(65) Prior Publication Data

US 2016/0374432 A1 Dec. 29, 2016

Related U.S. Application Data

(63) Continuation of application No. PCT/KR2015/007385, filed on Jul. 16, 2015.

(30) Foreign Application Priority Data

Jan. 21, 2015 (KR) ..... 10-2015-0010162

(51) Int. Cl.
*A43C 11/00* (2006.01)
*A43B 5/00* (2006.01)
(Continued)

(52) U.S. Cl.
CPC ..... *A43C 11/008* (2013.01); *A43B 5/00* (2013.01); *A43C 7/00* (2013.01); *A43C 7/08* (2013.01);
(Continued)

(58) Field of Classification Search
CPC ..... A43C 11/008; A43C 7/00; A43C 7/08; A43C 11/12; A43B 5/00; A44B 11/008; A44B 11/266
See application file for complete search history.

(56) References Cited

U.S. PATENT DOCUMENTS

2010/0218349 A1* 9/2010 Whang ..... A43C 7/00 24/712.2
2011/0016680 A1* 1/2011 Chang ..... A43C 7/00 24/712.5
(Continued)

FOREIGN PATENT DOCUMENTS

FR 2956567 A1 * 8/2011 ..... A43C 3/00
KR 20-1997-0004031 Y1 4/1997
(Continued)

OTHER PUBLICATIONS

International Search Report(PCT/KR2015/007385), WIPO, dated Sep. 23, 2015.

*Primary Examiner* — Victor D Batson
*Assistant Examiner* — Matthew J Sullivan
(74) *Attorney, Agent, or Firm* — Park & Associates IP Law, P.C.

(57) ABSTRACT

The present invention relates to a shoelace binding device and, more particularly, to a shoelace binding device that is more convenient by allowing shoelaces to be easily tied and untied, simply replaced, and easily pulled. The shoelace binding device includes: a center stopper fixing a first half and a second half of a shoelace at a middle portion of an instep of a shoe; and a buckle holding the first half and the second half of the shoelace at a middle portion of a neck of the shoe. The buckle includes a male buckle member and a female buckle member. The male buckle member has a male buckle body, a guide formed, and an elastic arm. The female buckle member has a female buckle body, a housing, and a side hole formed.

9 Claims, 4 Drawing Sheets

(51) Int. Cl.

| | |
|---|---|
| ***A43C 7/08*** | (2006.01) |
| ***A43C 11/12*** | (2006.01) |
| ***A43C 7/00*** | (2006.01) |
| ***A44B 11/00*** | (2006.01) |
| ***A44B 11/26*** | (2006.01) |

(52) U.S. Cl.
CPC ..... *A43C 11/12* (2013.01); *A44B 11/008* (2013.01); *A44B 11/266* (2013.01)

(56) References Cited

U.S. PATENT DOCUMENTS

| | | | | |
|---|---|---|---|---|
| 2011/0162177 | A1 | 7/2011 | Von Der Ahe et al. | |
| 2015/0101159 | A1* | 4/2015 | Renforth ..... | A01K 27/005<br>24/594.11 |

FOREIGN PATENT DOCUMENTS

| | | | |
|---|---|---|---|
| KR | 10-2002-0006491 | A | 1/2002 |
| KR | 20-0409510 | Y1 | 2/2006 |
| KR | 10-2009-0090860 | A | 8/2009 |
| KR | 10-2010-0109070 | A | 10/2010 |
| KR | 20-2011-0011759 | U | 12/2011 |

* cited by examiner

SHOELACE BINDING DEVICE

REFERENCE TO RELATED APPLICATIONS

This is a continuation of pending International Patent Application PCT/KR2015/007385 filed on Jul. 16, 2015, which designates the U.S. and claims priority of Korean Patent Application No. 10-2015-0010162 filed on Jan. 21, 2015, the entire contents of which are incorporated herein by reference.

FIELD OF THE INVENTION

The present invention relates to a shoelace binding device and, more particularly, to a shoelace binding device that is more convenient by allowing shoelaces to be easily tied and untied, simply replaced, and easily pulled.

BACKGROUND OF THE INVENTION

In general, shoes such as sneakers, hiking boots, and safety shoes have shoelaces to prevent the shoes from coming off the wearer's feet.

A shoelace is generally tied on the neck of a shoe by passing both ends of the shoelace through a series of holes on the instep and the neck in a zigzag shape and then tying a knot over the neck.

However, it is inefficient in terms of time, and it's troublesome and inconvenient to make a knot every time to tie both ends of a shoelace together, and when the shoelace is untied, an accident may be caused.

In order to solve this problem with a knot, a shoelace binding device composed of a center stopper, side stoppers, and a buckle has been proposed. According to this device, a user pulls and fixes both halves of a shoelace such that he/she can put on and take off a shoe using the center stopper and the side stoppers and then secure the halves using the buckle, whereby the user can tie the shoelace without a knot.

However, the buckle is composed of separable male buckle member and female buckle member, and in order to separate the male buckle member and the female buckle member that are fastened to each other, a user has to simultaneously press elastic arms of the male buckle member exposed through both sides of the female buckle member with the same force. However, it is difficult to hold the buckle when the buckle is in close contact with a shoe and simultaneously press both sides of the male buckle member with the same force.

Further, the center stopper fixes both halves of a shoelace in a close contact state, so it is difficult to individually pull the ends of the shoelace. Further, when the degrees of pulling the ends are different, it is difficult to adjust the ends to be equal.

Further, since the side stoppers fix both ends of a shoelace in a complicated form, it is difficult to separate or replace the shoelace for washing etc.

Accordingly, it is required to supplement and improve the structure of the center stopper, the side stoppers, and the buckle in order to solve the problems with the existing shoelace binding devices.

SUMMARY OF THE INVENTION

The present invention has been proposed to solve the problems in the related art and an object of the present invention is to provide a shoelace binding device having a structure allowing a shoelace to be easily tied and untied, simply separated and replaced, and easily pulled.

However, the objects of the present invention are not limited to those stated above and other objects not stated above may be clear to those skilled in the art from the following description.

In order to achieve the above object, according to one aspect of the present invention, there is provided a shoelace binding device including: a center stopper fixing a first half and a second half of a shoelace at a middle portion of an instep of a shoe; and a buckle holding the first half and the second half of the shoelace at a middle portion of a neck of the shoe. The buckle includes a male buckle member and a female buckle member. The male buckle member has: a male buckle body having a first coupler at a first end; a guide formed at a first side of a second end of the male buckle body and having a first guide surface on an outer side; and an elastic arm formed at a second side of the second end of the male buckle body at a predetermined distance from the guide, having flexibility to be bent toward the guide by force from the outside, and having a projection on an outer side and a second guide surface formed on an outer side of the projection. The female buckle member has: a female buckle body having a second coupler at a first end; a housing formed at a second end of the female buckle body and having a space for receiving the guide and the elastic arm; and a side hole formed through a side of the housing and securing the projection of the elastic arm such that the projection is exposed to the outside when the guide and the elastic arm are inserted in the space.

The first guide surface may be inclined toward the elastic arm.

The second guide surface may be inclined toward the guide.

A pair of first guide protrusions may be formed with a first guide groove therebetween on each of a top and a bottom of the guide, and a pair of second guide grooves corresponding to the first guide protrusions may be formed with a second guide protrusion corresponding to the first guide groove therebetween on each of upper and lower inner sides of the housing.

The first coupler may have a pair of first coupler holes formed in a line at both sides of the first end of the male buckle body.

The second coupler may have a pair of second coupler holes formed in a line at both sides of the first end of the female buckle body.

The shoelace binding device may further include a pair of side stoppers fixing the first half and the second half of the shoelace on both sides of the neck of the shoe, respectively.

The side stoppers may each have: a fixing body having a housing space and being fixed to the shoe; and a pressing lever rotatably coupled to a side of the fixing body to be inserted in the housing space of the fixing body and pressing and fixing an end portion of the first half or the second half of the shoelace passing through between the fixing body and the pressing lever.

A holder for holding the end portion of the first half or the second half of the shoelace may protrude on an outer side of the fixing body.

Grooves may be formed in a semicircular shape at upper and lower portions of an inner end of the pressing lever to pass ends of the first half and the second half of the shoelace.

Stopping holes and stopping protrusions for fixing the pressing lever by being fitted to each other when the pressing lever is turned inside the fixing body may be formed at upper and lower sides of the fixing body and the pressing lever, respectively.

The center stopper may have an inside divided into a first section, a second section, a third section, and a fourth section by a first separator, a second separator, and a third separator so that the first half of the shoe sequentially passes through the second section and the first section and the second half of the shoe sequentially passes through the third section and the fourth section such that the first half and the second half of the shoelace are fixed not in contact with each other in the sections.

According to the shoelace binding device of the present invention, it is possible to easily tie and untie a shoelace, simply separate and replace a shoelace, and easily pull a shoelace.

DETAILED DESCRIPTION OF THE INVENTION

A shoelace binding device according to the present invention is attached to a shoe so that a user can tie a shoelace without a knot by tightening and pulling the portions on the instep and the neck of a shoe to fit the internal space of the shoe to the user's foot.

In particular, according to the shoelace binding device of the present invention, it is easy to tie and untie a shoelace, simple to separate and replace a shoelace, and easy to pull a shoelace in order to improve convenience for a user.

The characteristics can be achieved by supplementing and improving a center stopper for simultaneously fixing two halves of a shoelace over the instep of a shoe, a pair of side stoppers for fixing the halves at both sides of the neck of a shoe, and a buckle for securing the ends of the halves of the shoelace over the neck of a shoe.

Embodiments of the present invention are described hereafter in detail with reference to the accompanying drawings.

Figure 2:
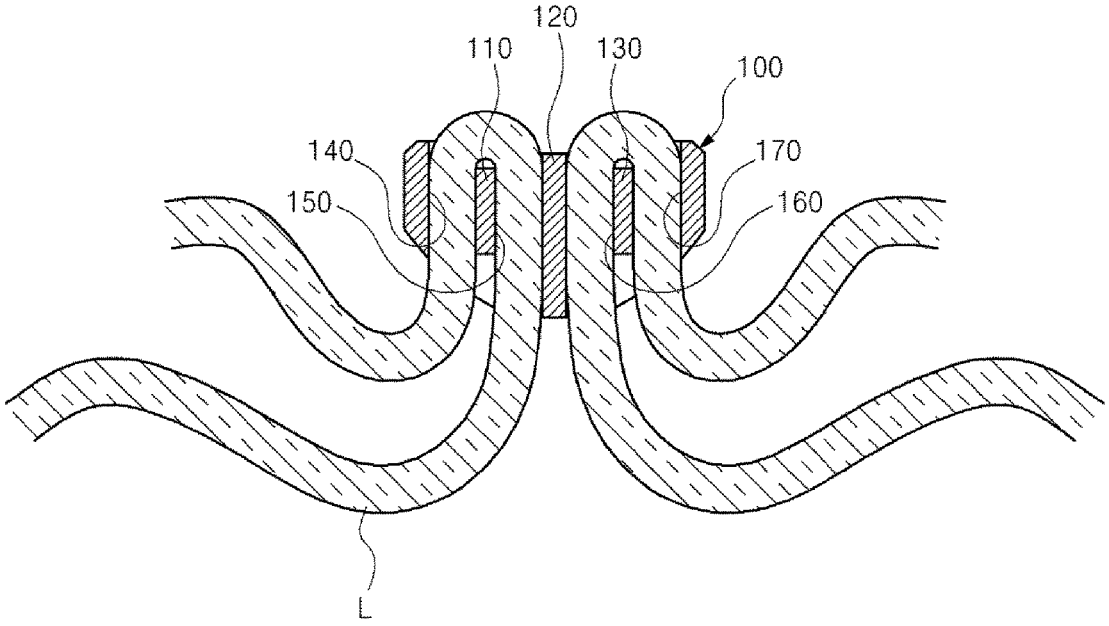
FIG. 2 is a cross-sectional view showing a center stopper of the shoelace binding device according to an embodiment of the present invention.

A shoelace binding device according to an embodiment of the present invention, as shown in FIG. 2, may include a center stopper 100, side stoppers 200, and a buckle 300.

Figure 1:
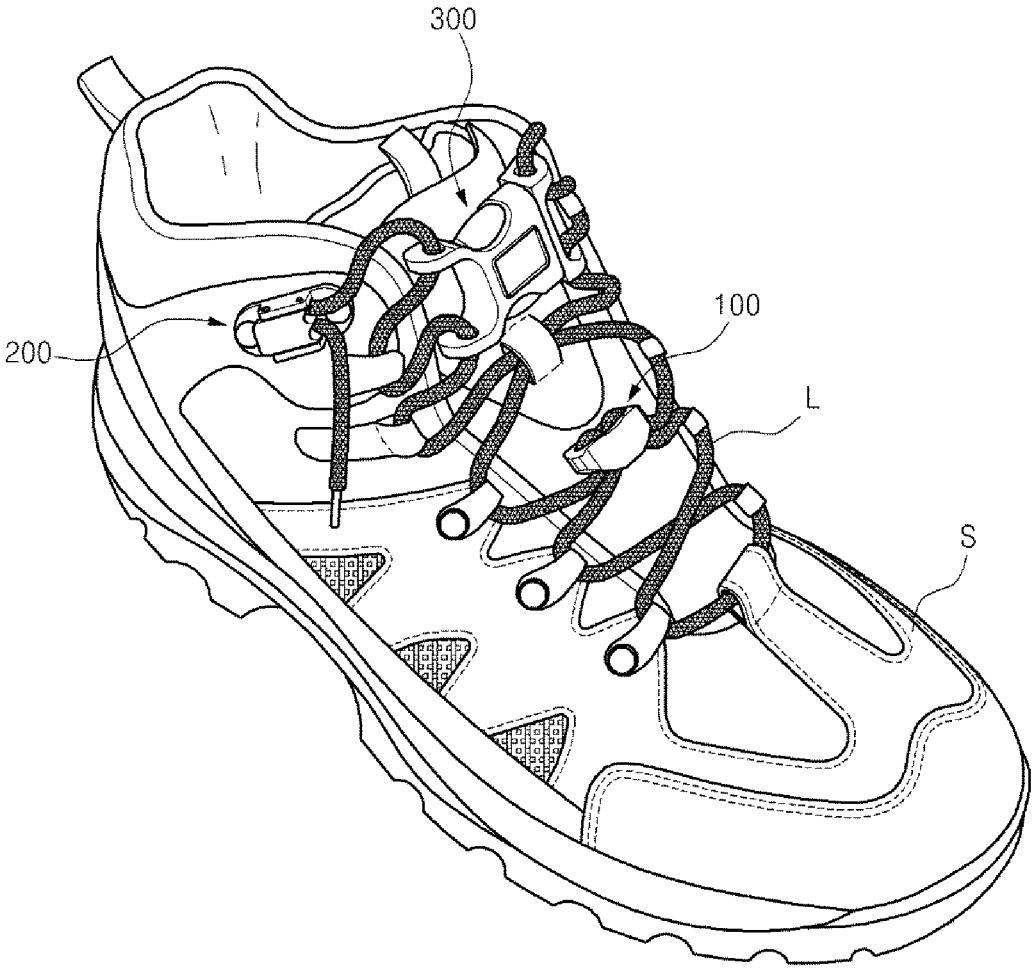
FIG. 1 is an exemplary view showing use of a shoelace binding device according to an embodiment of the present invention.

First, the center stopper 100, as shown in FIG. 1, is disposed on the middle portion of the instep of a shoe S to secure both of a first half and a second half of a shoelace L.

That is, the center stopper 100 is disposed on the middle portion of the instep of the shoe S, lower than the side stoppers 200 with respect to the position of the buckle 300 and secure the halves of the shoelace L by bending the halves in a U-shape therein.

To this end, the center stopper 100, as shown in FIG. 2, may have a first separator 110, a second separator 120, and a third separator 130 therein formed in parallel with each other with regular intervals so that the internal space of the center stopper 100 is divided into a first section 140, a second section 150, a third section 160, and a fourth section 170.

That is, the first half of the shoelace L is bent and fixed in a U-shape by the first separator 110 while sequentially passing through the second section 150 and the first section 140. Further, the second half of the shoelace L is bent and fixed in a U-shape by the third separator 130 while sequentially passing through the fourth section 170 and the third section 160.

The first half and the second half of the shoelace L are not in contact with each other by the second separator 120 in the center stopper 100, so it is possible to individually loosen and pull the halves.

Accordingly, when the first and second halves of the shoelace L are differently pulled, it is possible to simply make the lengths of them the same by individually loosening and pulling them.

It may be possible to make the second separator 120, which is disposed at the middle portion of the first separator 110, the second separator 120, and the third separator 130, longer than the first separator 110 and the third separator 130 in order to further make sure of preventing both halves of the shoelace L from coming in contact with each other.

On the other hand, the side stoppers 200, as shown in FIG. 1, are provided in a pair to individually secure the end portions of the first half and the second half of the shoelace L on both sides of the shoe S.

That is, the side stoppers 200 are fixed on both sides of the neck of the shoe S, higher than the center stopper 100 with respect to the position of the buckle 300 and bend and secure the end portions of the first half and the second half of the shoelace L in a U-shape by pressing them.

Figure 3:
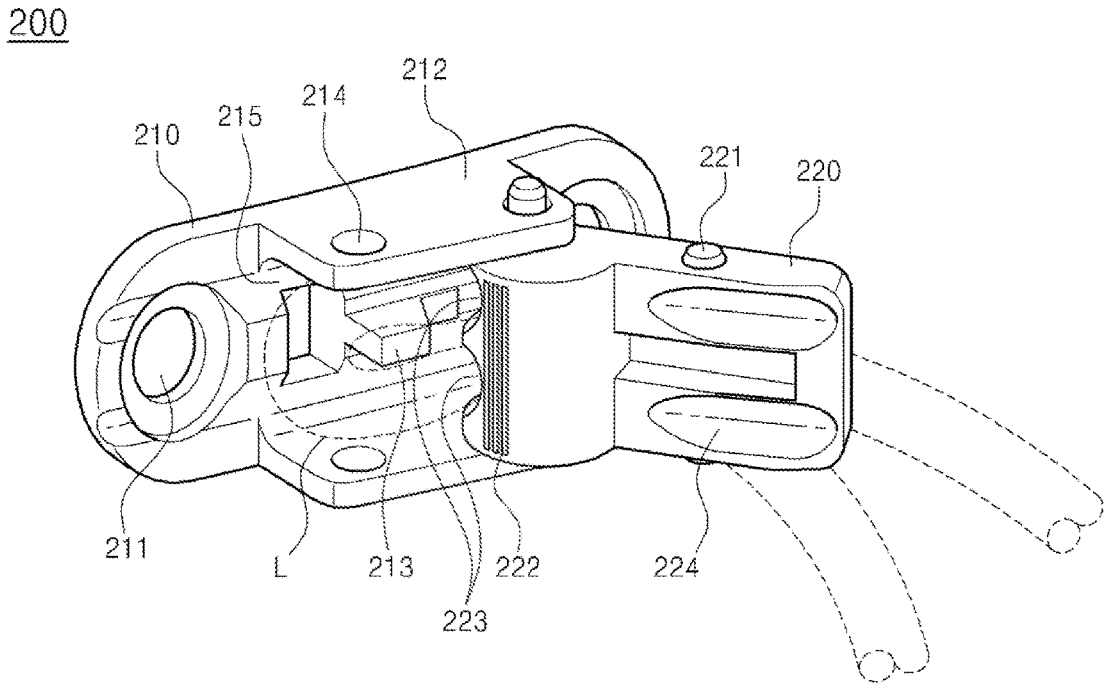
FIG. 3 is a perspective view showing a side stopper of the shoelace binding device according to an embodiment of the present invention.

To this end, the side stoppers 200 each may be composed of a fixing body 210 and a pressing lever 220, as shown in FIG. 3.

The fixing body 210 has a housing space therein and is fixed to the shoe S. The pressing lever 220 is rotatably coupled to the fixing body 210 to be inserted into the housing space of the fixing body 210.

That is, the first half or the second half of the shoelace L is pressed and secured by turning the pressing lever 220 into the fixing body 210 with the end of the first half or the second half of the shoelace L passing through between the fixing body 210 and the pressing lever 220 in a U-shape.

The fixing body 210 has fixing holes 211, supporting sides 212, and a holder 213. The fixing holes 211 are formed close to the left and right edges of the fixing body 210, respectively, and fasteners (not shown) for fixing the fixing body 210 to the shoe S are inserted in the fixing holes 211.

The supporting sides 212 are formed at upper and lower portions of the fixing body 210, respectively, to rotatably support an end of the pressing lever 220 and provide the housing space where the pressing lever 220 is inserted.

A stopping hole 214 that is fitted on a stopping protrusion 221 formed on the upper and lower sides of the pressing lever 220 may be formed through a predetermined portion of each of the supporting sides 212 to preventing the pressing lever 220 from turning outward when the pressing lever 220 is inserted in between the supporting sides 212.

The holder 213 protrudes between the supporting sides 212 on the outer side of the fixing body 210 to lock the first half or the second half of the shoelace L in a U-shape when the end of the first half or the second half comes out under the holder after being inserted over the holder. The holder 213 may have a height corresponding to the thickness of the shoelace L so that the shoelace L can be sufficiently locked.

The pressing lever 220 has the stopping protrusion 221, pressing protrusions 222, and grooves 223. The pressing protrusions 221 are formed on the upper and lower sides of the pressing lever 220, as described above.

The pressing protrusions 222 are formed on the inner side of the pressing lever 220 and press the first half or the second half of the shoelace L when the pressing lever 220 is turned inside the fixing body 210.

The grooves 223 are formed in a semicircular shape at upper and lower portions of the inner end of the pressing lever 220 and each provide a space so that the shoelace L can be smoothly moved between the pressing lever 220 and the fixing body 210 without the pressing lever 220 turned inside the fixing body 210.

Accordingly, the end portion of the first half or the second half of the shoelace L is simply secured in a U-shape in the side stopper 200, so it is possible to easily secure and replace the shoelace L.

Meanwhile, guide grooves 215 and 224 for holding the end portion of the first half or the second half of the shoelace L in place with the pressing lever 220 turned inside the fixing body 210 may be formed respectively on the outer side of the fixing body 210 and the outer side of the pressing lever 220.

Finally, the buckle 300, as shown in FIG. 1, holds a crossover of the first half and the second half of the shoelace L at the middle portion of the neck of the shoe S. To this end, the buckle 300 may be composed of a female buckle member 500 and a male buckle member 400 that are separably fitted to each other.

Figure 4:
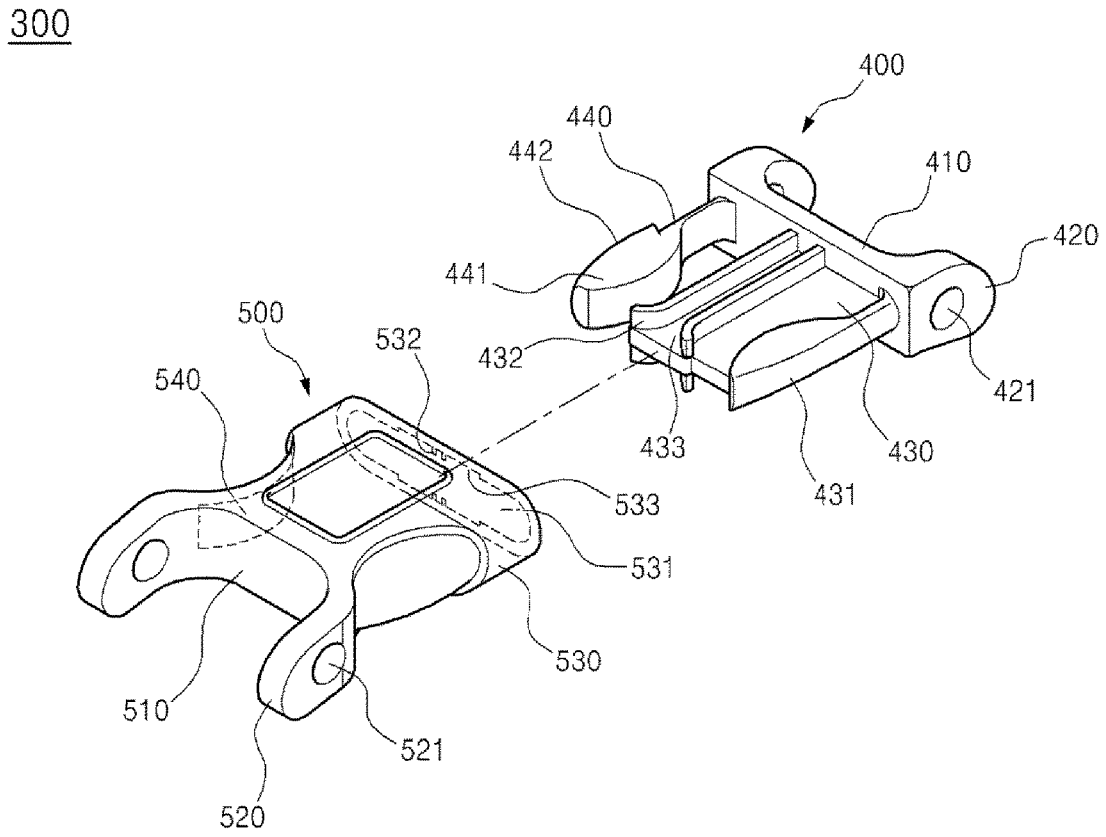
FIG. 4 is a perspective view showing a buckle of the shoelace binding device according to an embodiment of the present invention when the buckle is unlocked.

The male buckle member 400, as shown in FIG. 4, may have a male buckle body 410, a guide 430, and an elastic arm 440.

The male buckle body 410, which supports the guide 430 and the elastic arm 440, may have a first coupler 420 at a first end to couple the shoelace L to the male buckle member 400. The first coupler 420 may have a pair of coupling holes 421 formed in a line at both sides of the first end of the male buckle body 410.

The guide 430 is formed at a second end of the male buckle body 410 to be inserted into the female buckle member 500 with the elastic arm 440 so that the elastic arm 440 is secured in the female buckle member 500 when the male buckle member 400 and the female buckle member 500 are fastened.

That is, the guide 430 has a first guide surface 431 on the outer side and the first guide surface 431 may be inclined inward toward the middle portion of the male buckle body 410.

The elastic arm 440 is formed at a second end of the male buckle body 410 to be inserted into the female buckle member 500 with the guide 430 and secured therein so that the male buckle member 400 is not separated from the female buckle member 500 when the male buckle member 400 and the female buckle member 500 are fastened.

The elastic arm 440 is formed at predetermined distance from the guide 430 and has flexibility to be bent toward the guide 430 when external force is applied.

A projection 441 may be formed on the outer side of the elastic arm 440. A second guide surface 442 is formed on the outer side of the projection 441 and it may be inclined inward toward the middle portion of the male buckle body 410.

The female buckle member 500 may have a female buckle body 510, a housing 530, and a side hole 540.

The female buckle body 510, which supports the housing 530, may have a second coupler 520 at a first end to couple the shoelace L to the female buckle member 500. The second coupler 520 may have a pair of second coupling holes 521 formed in a line at both sides of the first end of the female buckle body 510.

The housing 530 is formed at a second end of the female buckle body 510 to receive the guide 430 and the elastic arm 440 of the male buckle member 400 when the female buckle member 500 and the male buckle member 400 are fastened.

To this end, the housing 530 may have an open side and a space 531 therein. The space 531 may be formed to correspond to the shape made by the guide 430 and the elastic arm 440 so that the guide 430 and the elastic arm 440 can be received therein.

That is, when the guide 430 and the elastic arm 440 are inserted into the housing 530, the first guide surface 431 and the second guide surface 442 come in contact with both inner sides of the housing 530 and the elastic arm 440 is bent toward the guide 430. Accordingly, the gap between the guide 430 and the elastic arm 440 decreases, so the guide 430 and the elastic arm 440 are smoothly inserted into the housing 530.

The side hole 540 is formed through a side of the housing 530 to secure the projection 440 when the guide 430 and the elastic arm 440 are inserted in the housing 531 so that the male buckle member 400 cannot be separated from the female buckle member 500.

That is, the elastic arm 440 is elastically returned to the initial position from the guide 430 when the guide 430 and the elastic arm 440 are fully inserted in the space 531, so the projection 441 is secured in the side hole 540 and exposed to the outside.

Accordingly, when the projection 441 of the male buckle member 400 is pressed by predetermined or more force, the projection 441 is pushed inward through the side hole 540 and the guide 430 and the elastic arm 440 are separated from the housing 530, so the male buckle member 400 and the female buckle member 500 are separated.

On the other hand, as shown in FIG. 4, a pair of first guide protrusions 432 may be formed on both of the top and bottom surfaces of the guide 430 with a pair of first guide grooves 433 between the guide protrusions 432, and a pair of second guide grooves 533 may be formed on both of the upper and lower inner sides of the housing 530 with a pair of second guide protrusions in the guide grooves 533.

The first guide protrusions 432 may be formed in a shape corresponding to the second guide grooves 533 and the second guide protrusion 532 may be formed in a shape corresponding to the first guide grooves 433.

When the guide 430 and the elastic arm 440 are inserted into the space of the housing 530, the first guide protrusions 432 and the second guide protrusions 532 are guided by the second guide grooves 533 and the first guide grooves 433, respectively, in order that the guide 430 and the elastic arm 440 can be inserted in place.

According to the shoelace binding device of the present invention, as described above, it is possible to easily tie and untie a shoelace, simply separate and replace a shoelace, and easily pull a shoelace by improving the structures of a center stopper, a side stopper, and a buckle, so a user can more conveniently use the device.

The embodiment is provided just as an example and the present invention may be modified in various ways by those skilled in the art.

Therefore, not only the embodiment, other modifications should be included in the technical protective range of the present invention by the spirit of the present invention described in claims.

The present invention relates to a shoelace binding device and, more particularly, it may be applied to a shoelace binding device that is more convenient by allowing shoelaces to be easily tied and untied, simply replaced, and easily pulled.

What is claimed is:

1. A shoelace binding device comprising:

a center stopper fixing a first half and a second half of a shoelace at a middle portion of an instep of a shoe;

a buckle holding the first half and the second half of the shoelace at a middle portion of a neck of the shoe; and a pair of side stoppers fixing the first half and the second half of the shoelace on both sides of the neck of the shoe, respectively, wherein the buckle includes a male buckle member and a female buckle member, wherein the male buckle member has: a male buckle body having a first coupler at a first end; a guide formed at a first side of a second end of the male buckle body and having a first guide surface on an outer side; and an elastic arm formed at a second side of the second end of the male buckle body at a predetermined distance from the guide, having flexibility to be bent toward the guide by force from the outside, and having a projection on an outer side and a second guide surface formed on an outer side of the projection, wherein the female buckle member has: a female buckle body having a second coupler at a first end; a housing formed at a second end of the female buckle body and having a space for receiving the guide and the elastic arm; and a side hole formed through a side of the housing and securing the projection of the elastic arm such that the projection is exposed to the outside when the guide and the elastic arm are inserted in the space, wherein the side stoppers each have: a fixing body having a housing space and fixed to the shoe; and a pressing lever rotatably coupled to a side of the fixing body so to be inserted in the housing space of the fixing body and for pressing and fixing an end portion of the first half or the second half of the shoelace passing through between the fixing body and the pressing lever, wherein stopping holes and stopping protrusions for fixing the pressing lever to the fixing body by fixing engagement, when the pressing lever is turned toward the fixing body, are formed at upper and lower sides of the fixing body and the pressing lever, respectively.

2. The device of claim 1, wherein the first guide surface is inclined toward the elastic arm.

3. The device of claim 1, wherein the second guide surface is inclined toward the guide.

4. The device of claim 1, wherein a pair of first guide protrusions are formed on each of a top and a bottom surfaces of the guide with a pair of first guide grooves between the first guide protrusions, and wherein a pair of second guide grooves corresponding to the first guide protrusions are formed on each of upper and lower inner surface areas of the housing with a pair of second guide protrusions corresponding to the first guide grooves formed in the guide grooves.

5. The device of claim 1, wherein the first coupler has a pair of first coupler holes formed in a line at both sides of the first end of the male buckle body.

6. The device of claim 1, wherein the second coupler has a pair of second coupler holes formed in a line at both sides of the first end of the female buckle body.

7. The device of claim 1, wherein a holder for holding the end portion of the first half or the second half of the shoelace protrudes on an outer side of the fixing body.

8. The device of claim 1, wherein grooves are formed in a semicircular shape at upper and lower portions of an inner end of the pressing lever to pass ends of the first half and the second half of the shoelace.

9. The device of claim 1, wherein the center stopper has an inside divided into a first section, a second section, a third section, and a fourth section by a first separator, a second separator, and a third separator so that the first half of the shoe sequentially passes through the second section and the first section and the second half of the shoe sequentially passes through the third section and the fourth section such that the first half and the second half of the shoelace are fixed not in contact with each other in the sections.

* * * * *